US005697297A

United States Patent [19]

Rasmussen

[11] Patent Number: 5,697,297

[45] Date of Patent: Dec. 16, 1997

[54] INTERCHANGEABLE DIFFERENT PRINTING TECHNOLOGIES MODULES FOR A WEB PRINTING ASSEMBLY

[75] Inventor: Torben Rasmussen, Hvidovre, Denmark

[73] Assignee: nilpeter a/s, Slagelse, Denmark

[21] Appl. No.: 696,926

[22] PCT Filed: Apr. 26, 1995

[86] PCT No.: PCT/DK95/00175

§ 371 Date: Aug. 16, 1996

§ 102(e) Date: Aug. 16, 1996

[87] PCT Pub. No.: WO95/29813

PCT Pub. Date: Nov. 9, 1995

[30] Foreign Application Priority Data

Apr. 28, 1994 [DK] Denmark ..... 0501/94

[51] Int. Cl.[6] ..... B41F 5/04

[52] U.S. Cl. ..... 101/219; 101/211; 101/247; 101/248

[58] Field of Search ..... 101/216, 218, 101/219, 247, 248, 352, 25, 211

[56] References Cited

U.S. PATENT DOCUMENTS

| | | | |
|---|---|---|---|
| 1,949,362 | 2/1934 | Wickwire, Jr. | 101/25 |
| 4,384,522 | 5/1983 | Ehlers et al. | 101/247 |
| 4,413,541 | 11/1983 | Biggar, III | 83/346 |
| 4,462,311 | 7/1984 | Armelin | 101/218 |
| 4,491,070 | 1/1985 | Fischer | 101/181 |
| 4,616,564 | 10/1986 | Faddis et al. | 101/218 |
| 4,839,814 | 6/1989 | Steider | 101/248 |
| 4,887,529 | 12/1989 | Ichikawa | 101/181 |
| 4,960,048 | 10/1990 | Sarda | 101/247 |
| 5,163,368 | 11/1992 | Pensavecchia et al. | 101/183 |
| 5,392,710 | 2/1995 | Li | 101/219 |
| 5,429,044 | 7/1995 | Giurl et al. | 101/33 |
| 5,540,149 | 7/1996 | Hoge | 101/352 |

FOREIGN PATENT DOCUMENTS

87/04665 8/1987 WIPO .

*Primary Examiner*—Eugene H. Eickholt
*Attorney, Agent, or Firm*—Klein & Szekeres, LLP

[57] ABSTRACT

A highly flexible printing apparatus is provided comprising printing modules (A–F) and cassettes (8) containing different web processing means. Each of the cassettes (8) is adapted to be mounted on a selected printing module (A–F) to cooperate with the module (A–F) during production of printed matters and contains means for a specific web processing technology that will be provided by the selected printing module (A–F) when the cassette (8) has been mounted to it. The different cassettes (8) may contain web processing means of a great variety, such as offset printing means, dry offset printing means, letterpress printing means, serigraphy means, hot foil application means, flexographic means, raised printing means, punching means, means for printing electronically generated images, etc. With the new printing apparatus provided, a printing house will be able to produce printed matters in one single working process on a single printing apparatus as an operator of the printing apparatus is free to configurate the printing apparatus with web processing technologies in a desired order as needed for production of a specific printed matter. For example a cassette (8) intended for offset printing may contain a plate cylinder (9) and a blanket cylinder (10). When mounted on the printing module (A–F) these cylinders cooperate with the impression cylinder (5), the ink roller system (7), the moisture roller system (7), and the other means of the printing module (A–F) to do offset printing.

11 Claims, 2 Drawing Sheets

INTERCHANGEABLE DIFFERENT PRINTING TECHNOLOGIES MODULES FOR A WEB PRINTING ASSEMBLY

BACKGROUND OF THE INVENTION

The present invention relates to a printing apparatus comprising at least one printing module.

Printing houses producing printed matter, such as labels, booklets, etc., experience tough competition in the market place. The market demands more and more special effects of printed matters, such as high resolution graphics, a great variety of colours, strong colours, thick layers of colours, hot foil application, punching, etc. Therefore, the printing houses need to be able to apply many different technologies during production of printed matter and they need to be able to apply these technologies in different sequences for different printed matters.

Printing apparatuses of a modular concept wherein a printing module comprises all the means necessary to utilize a specific technology for processing a web are known. A printing apparatus is made by mounting selected printing modules in a desired sequence in a row adjacent to each other. For example a label printing machine could comprise two serigraphy modules followed by two letterpress modules, a hot foil application module, another letterpress module, two flexographic modules, and finally a punching module. A printing apparatus manufactured this way is called an in line printing apparatus. This modular concept enables the manufacturer of printing apparatuses to customize his end product to fit the production process desired by his customer.

However, once the printing apparatus has been composed with the printing modules arranged in a specific sequence this sequence can not be changed without reengineering the apparatus. As different kinds of printed matter often require that the different technologies available to the printing house is applied in different order during production of different printed matters, the printing house has to move intermediate products between different production machinery during production.

It is well known to provide the flexibility needed within each printing module so as to be able to produce different formats of printed matter having different lengths or dimensions in the longitudinal direction of the web.

Conventionally, the problem is solved by exchanging the printing cylinders or punching cylinders so that the printing and/or punching cylinder used has a peripheral length corresponding to the length or longitudinal dimension of the format to be printed. For example from WO 87/04665 it is known to mount the plate cylinder and the blanket cylinder of an offset printing machine in a cartridge which is arranged on one side of the web and which may be withdrawn axially thereby facilitating the exchange or cleaning of the plate and blanket cylinders.

SUMMARY OF THE INVENTION

The present invention provides an improved printing apparatus of the above type.

Thus, the present invention provides a printing apparatus comprising at least one printing module each of which comprises a main frame with an impression cylinder, guide rollers for guiding the web along a web path, and receiving means for detachably receiving a cassette containing means for processing the web and means for cooperating with the impression cylinder, the cassette being positioned exclusively at one side of the web path so that the cassette may be mounted in or removed from said printing module without breaking or removing the web.

The present invention also provides a printing apparatus, wherein the printing module further comprises an ink roller system, and/or a moisture roller system, or a combined ink and moisture roller system, and means for selectively moving the ink roller and/or the moisture roller systems or the combined ink and moisture roller system between their inoperative position and their operative position in which ink and moisturizing liquid, respectively, is supplied into the cassette. Further the printing module may comprise feed rollers for feeding the web.

The printing apparatus according to the invention has an increased flexibility compared to known printing apparatus as a printing house will be able to produce printed matters in one single working process on a single printing apparatus as an operator of the printing apparatus is free to configure the printing apparatus with web processing technologies in a desired order as needed for production of a specific printed matter.

A plurality of cassettes containing different web processing means may be associated with each of the printing modules to cooperate with the module during production of printed matters. Each of the cassettes contains means for a specific web processing technology that will be provided by the printing module when the cassette has been mounted to it. The different cassettes may contain web processing means of a great variety, such as offset printing means, dry offset printing means, letterpress printing means, serigraphy means, hot foil application means, flexographic means, raised printing means, punching means, means for printing electronically generated images, etc.

For example a cassette intended for offset printing may contain a plate cylinder and a blanket cylinder. When mounted on the printing module these cylinders cooperate with the impression cylinder, the ink roller system, the moisture roller system, and the other means of the printing module to do offset printing. In order to be able to produce different formats of printed matter having different lengths or dimensions in the longitudinal direction of the web a plurality of offset cassettes with plate cylinders and blanket cylinders of different diameters may be provided.

As described above a specific printing module with a specific cassette mounted thereon provides all the means necessary to carry out a specific web processing. It is preferred to design printing modules and cassettes according to the invention so that the number of means in the cassettes is minimized. However, it is of course possible to divide the web processing means between the printing modules and the cassettes in many different ways. It might even be practical and convenient to duplicate some of the means. Further it is preferred to provide several kinds of printing modules each of which contains different kinds of web processing means and therefore offers different degrees of flexibility. This enables the manufacturer of printing modules to offer a range of printing modules at prices that correlate with the flexibility of the corresponding printing module.

Thus, one printing module may contain substantially all the means that are common for several different web processes, such as a main frame with an impression cylinder, feed rollers for feeding a web to the impression cylinder, guide rollers for guiding the web along a web path, an ink roller system, and a moisture roller system, means for controlling the positioning of the web, etc.

Another and more simple printing module may contain all the means of the printing module described above except that in stead of an ink roller system and a moisture roller system the printing module contains a sledge without these roller systems.

The cassette may be driven by the printing module and preferably the cassette engages with a cogwheel provided on the shaft of the impression cylinder to be driven by when mounted on the printing module. The impression cylinder of the printing module is driven through a differential gear so that the rotational position of the cylinders of the cassette are adjustable also when the cassette is mounted on the printing module. Thereby, each module can be brought into register with the other modules, i.e. the positions of the printed or punched images produced by each printing module can be adjusted to match each other.

It will be appreciated that exchanging of one cassette with another in a printing module completely changes the web processing technology provided by that printing module. For example during one production batch of printed matters a printing apparatus according to the invention could be configured for production of labels in four different colours. Such a configuration could be made by mounting four cassettes for offset printing onto four printing modules followed by a printing module with a cassette containing a punching cylinder. After production of these labels the printing apparatus could be reconfigured for production of labels with two colours and a foil with raised printing. This reconfiguration could be made by removing two of the offset cassettes from the corresponding printing modules and in stead mounting a cassette with hot foil and raised printing means on a printing module in such a way that the offset printing and the foil application are done in the desired order for the production of the new labels.

DETAILED DESCRIPTION OF THE INVENTION

Figure 1A:
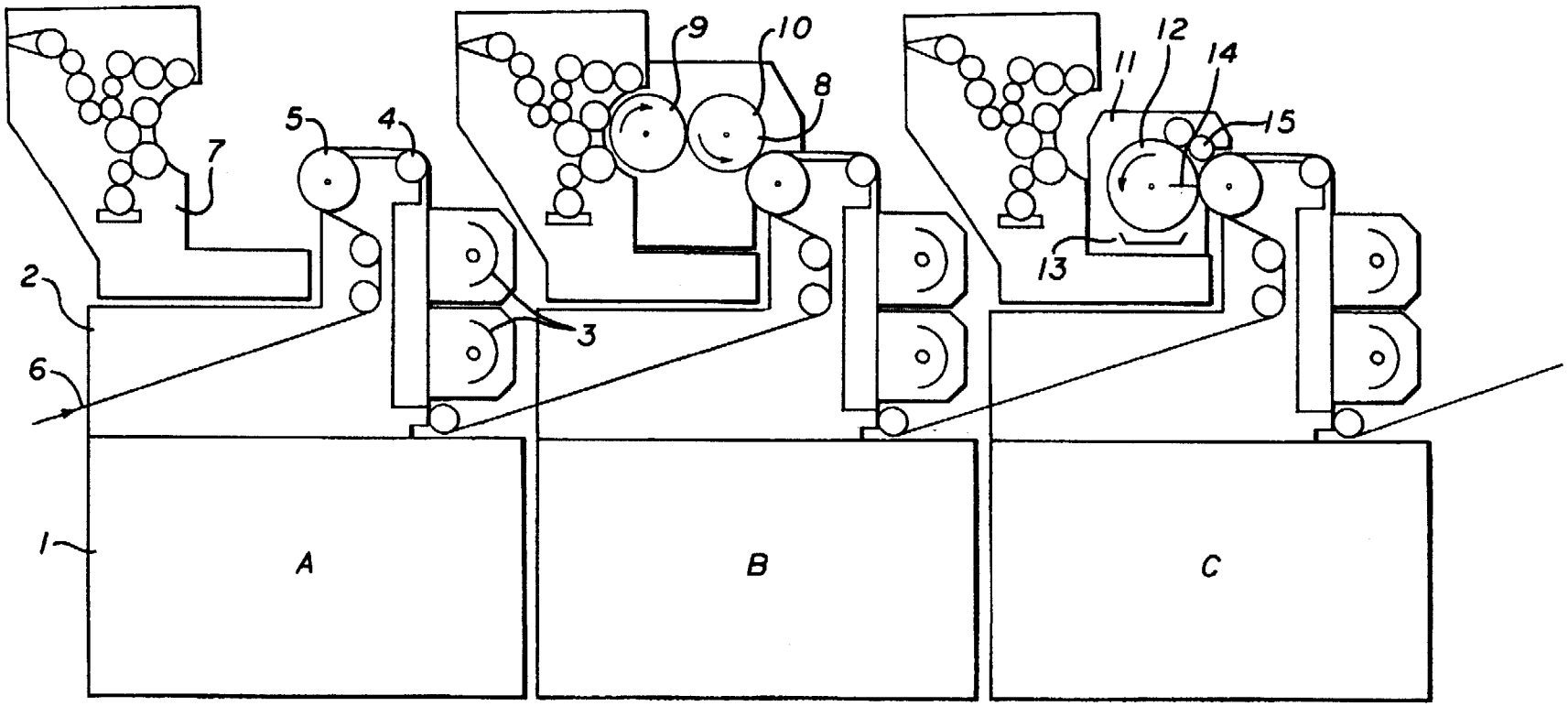
Figure 1B:
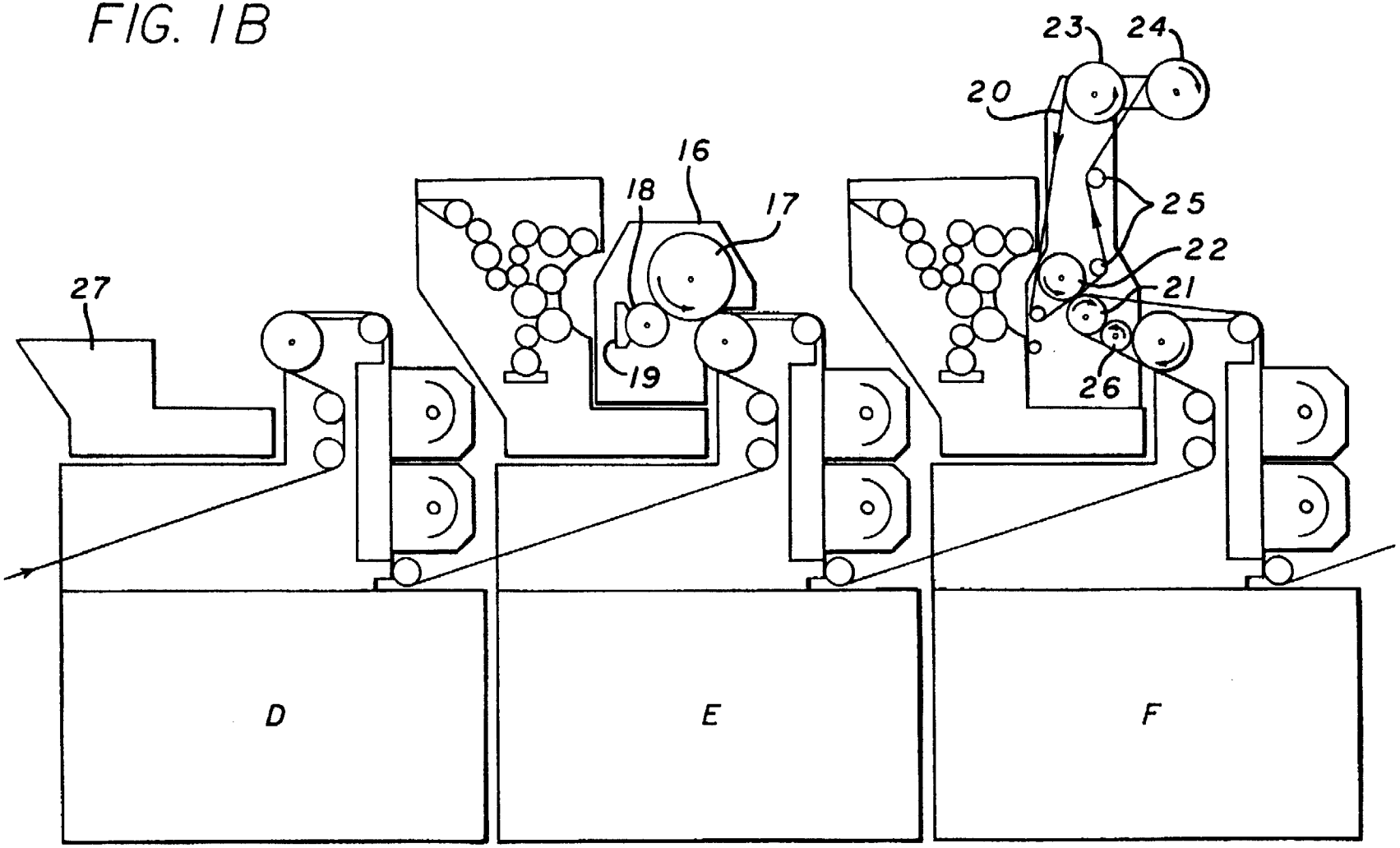

The invention will now be further described with reference to the drawing, which is a diagrammatic view of an embodiment of a printing apparatus according to the invention. The configuration of the printing apparatus shown in the FIGURE is not a practical example of a configuration of a printing apparatus as used in a printing house. It serves only to illustrate the flexibility and many configuration possibilities of the printing apparatus according to the invention.

The FIGURE shows a printing apparatus according to the invention comprising six printing modules A–F positioned adjacent to each other in a single row. A web 6, e.g. a paper web, is fed through the printing apparatus along a web path through each of the printing modules A–F.

All the modules A–F shown, except module D, have a console 1, a main frame 2, a drying section 3 for drying material applied to the web 6, guide rollers 4 for guiding the web 6, an impression cylinder 5 which may cooperate with the means of a cassette, and an ink roller and moisture roller system 7 for supplying ink and moisturizing liquid, respectively, into the cassette. The ink and moisture roller system 7 is mounted on guide rails so that its position in relation to the impression cylinder is adjustable both along and transversely to the longitudinal axis of the printing apparatus. The ink and moisture roller system 7 further comprises receiving means for the cassettes including fastening means for fastening the cassette to the ink and moisture roller system 7 and keeping the cassette in an accurate alignment in relation to the impression cylinder 5.

According to a preferred embodiment of the invention the web inlet and the web outlet are positioned at substantially the same height above ground level thereby facilitating the transport of the web from one printing module to the next printing module.

An offset printing cassette 8 is mounted on printing module B. It contains a plate cylinder 9 for carrying a plate and a blanket cylinder 10 which is in contact with the plate of the plate cylinder 9 and transfers ink, fed onto the plate, to the upper surface of the web 6 which passes through the nip between the blanket cylinder 10 and the impression cylinder 5. The contact pressure between the blanket cylinder 10, the web 6, and the impression cylinder 5 is controlled by adjusting the position of the ink and moisture roller system 7 with the cassette 8 in the longitudinal direction of the printing apparatus in relation to the impression cylinder 5.

A serigraphy cassette containing a stencil 12 carrying the image to be printed, a waste container 13, a doctor blade 14 forcing the ink through the screen of the stencil, and transmission gear 15 is mounted on printing module C.

The printing module D is a module with a sledge with receiving and fastening means substantially identical to the means of the ink and moisture roller system of module A for the cassettes. No cassette is mounted on printing module D.

A flexographic cassette 16 containing a plate cylinder 17 carrying the photopolymer cliche picking up the ink from an anilox roller 18, the ink supplied by a chambered doctor blade 19 is mounted on printing module E.

A foil relief printing cassette 20 is mounted on printing module F and contains a rubber impression cylinder 21, a heated relief printing cylinder 22 with an engraved surface for applying foil to the web 6, a supply reel 23 for the supply of the foil, a take-up reel for waste foil, guide rollers 25 for guiding the foil along a foil path, and transmission gear 26 for the heated relief printing cylinder 22. For this particular construction of a foil relief printing cassette 20 it is necessary to remove or break the web 6 to be able to enter it into the foil cassette 20.

What is claimed is:

1. A printing apparatus comprising a plurality of printing modules positioned adjacent to each other in a row and interchangeable different cassettes utilizing different web processing technologies, each printing module comprising a main frame with an impression cylinder, guide rollers for guiding a web along a web path, receiving means for detachably receiving a cassette, and a drying section for drying material applied to the web, the module defining a web inlet and a web outlet positioned at substantially the same height above ground level, thereby facilitating the transport of the web from one printing module to another printing module, and each cassette containing first means for processing the web and second means for cooperating with the impression cylinder of a corresponding printing module when the cassette is operationally attached to the printing module, so that an operator of the printing apparatus can configure the printing apparatus with the web processing technologies in a desired order as needed for production of a specified printed matter, maintaining access to the first and second means of the cassette when the cassette is operationally attached to the printing module.

2. A printing apparatus according to claim 1, wherein the printing module further comprises an ink roller system, and/or a moisture roller system, or a combined ink and moisture roller system, and means for selectively moving the ink roller and/or the moisture roller systems or the combined ink and moisture roller system between their inoperative position and their operative position in which ink and moisturizing liquid, respectively, is supplied into the cassette.

3. A printing apparatus according to claim 1, wherein the printing module further comprises feed rollers for feeding the web.

4. A printing apparatus according to claim 1 and comprising a cassette which contains a plate cylinder and a blanket cylinder cooperating with the impression cylinder for offset printing.

5. A printing apparatus according to claim 1 and comprising a cassette containing a letterpress printing means.

6. A printing apparatus according to claim 1 and comprising a cassette containing serigraphy means.

7. A printing apparatus according to claim 1 and comprising a cassette containing a hot foil application means.

8. A printing apparatus according to claim 1 and comprising a cassette containing punching means.

9. A printing apparatus according to claim 1 and comprising a cassette containing means for printing an electronically generated image on the web.

10. A printing apparatus according to claim 1 adapted to produce labels.

11. A printing apparatus according to claim 1 adapted to produce adhesive labels.

* * * * *